United States Patent [19]

Yu

[11] 4,166,495

[45] Sep. 4, 1979

[54] INGOT CASTING METHOD

[75] Inventor: Ho Yu, Murrysville, Pa.

[73] Assignee: Aluminum Company of America, Pittsburgh, Pa.

[21] Appl. No.: 885,950

[22] Filed: Mar. 13, 1978

[51] Int. Cl.[2] ..... B22D 11/00; B22D 11/124

[52] U.S. Cl. ..... 164/89; 164/82; 164/122

[58] Field of Search ..... 164/82, 89, 443, 444, 164/348, 122, 126, 128

[56] References Cited

U.S. PATENT DOCUMENTS

| | | | |
|---|---|---|---|
| 3,441,079 | 4/1969 | Bryson | 164/89 |
| 3,713,479 | 1/1973 | Bryson | 164/89 |
| 3,726,336 | 4/1973 | Moritz | 164/89 |
| 4,019,560 | 4/1977 | Gruner et al. | 164/444 |

*Primary Examiner*—Othell M. Simpson
*Assistant Examiner*—K. Y. Lin
*Attorney, Agent, or Firm*—Carl R. Lippert; William J. O'Rourke

[57] ABSTRACT

A method of continuously casting metal ingots is provided comprising the steps of introducing molten metal into an open-ended mold, applying a liquid cooling medium to the mold to effectuate at least partial solidication of the molten metal in the mold and advancing an ingot from the mold, with the ingot having the peripheral portion, at least, solidifed while applying liquid cooling medium to the exterior surface of the emerging ingot. The improvement of the present invention comprises retarding the cooling effect of the liquid cooling medium by mixing a gas with the medium to be applied to the ingot surface prior to application of the medium to the ingot surface, whereupon the gas forms a layer of gaseous insulation between the medium and the ingot surface upon application of the medium to the ingot surface.

49 Claims, 5 Drawing Figures

INGOT CASTING METHOD

BACKGROUND OF THE INVENTION

1. Field of Invention

The present invention pertains to the casting of ingot. More particularly, this invention is directed to retardation of cooling during the initial stages of the continuous casting of an aluminum ingot in order to optimize shrinkage and minimize distortion in the butt or start end of the ingot.

2. Description of the Art

Traditionally, continuous casting of light metal ingot in the vertical or horizontal direction has followed the practice of introducing molten metal into one end of an open-ended mold. During pouring, the molten metal temperature is preferably held substantially constant to maximize casting efficiency. Typically, the casting mold is relatively short in the axial direction and is hollow or otherwise adapted to receive a liquid cooling medium, such as water, directly against the exterior of the mold. Molds are preferably constructed of aluminum but may also be copper or bronze, all of which exhibit high thermal conductivity. Throughout the casting operation, the cooling medium is applied against the mold in a sufficient amount to extract heat from the molten metal adjacent the mold wall to effectuate at least partial solidification of the molten metal therein. Such cooling produces solidified peripheral portions of an ingot having sufficient mechanical strength and thickness to support a molten phase or generally wedge-shaped crater within the ingot as the ingot is continuously advanced from the exit end of the mold.

At the initiation of the vertical casting operation when molten metal is first introduced into the mold, the bottom or exit end of the mold is closed by a vertically movable bottom block. The ingot is advanced downwardly through the exit end of the mold by moving the bottom block downwardly. The amount of metal removed from the mold as the ingot is advanced from the exit end of the mold is constantly replaced with molten metal poured into the upper or entrance end of the mold. The metal head, i.e. the axial distance from the meniscus of the molten metal to the exit end of the mold, is preferably held constant throughout the casting operation. Lubricants may also be applied to the inside surfaces of the mold to reduce friction between the mold and the ingot and thereby prevent tearing during emergence of the ingot.

It is also conventional practice to apply a liquid cooling medium directly against the exterior surfaces of the emerging ingot. Such a direct cooling applied against the ingot is of sufficient quantity to eventually solidify the interior molten core of the ingot. Transverse solidification of the ingot is progressive such that complete solidification occurs at some axially removed distance away from the exit end of the mold. The supply of coolant applied directly against the ingot may be integral with or separate from the supply of coolant applied to the mold.

As an ingot begins to emerge from a mold, the exterior surfaces of the ingot are directly subjected to cooling, referred to as direct chill. The bottom block is also cooling the ingot butt axially. The thermal gradient between the mold cooling and the direct cooling is significant. The bottom block also generates a substantial thermal gradient for the first few inches of casting. As a result, the butt end of the emerging ingot is subjected to thermally induced stress and strain. Such rapid cooling of the butt end of the ingot causes geometric changes in the ingot as a result of advanced thermal contraction and shrinkage upon rapid solidification. The most common deformities occurring on the butt end or the initially emerging bottom surface of the ingot are known as butt curl and butt swell.

Butt curl is the term used to describe the rounded contour or shape of the butt or buttom end of a continuously cast ingot, as illustrated in FIG. 2. The extent of curl is determined by measuring the vertical distance between the lower corner of an ingot face and the top edge of the starting block, indicated by dimension A in FIG. 2. Curl is caused by thermally induced strains in the ingot mass that arise as a result of an excessively rapid cooling of the emerging butt end of an ingot. Curl decreases as ingot width approaches ingot thickness, thus square or round ingots do not exhibit much curl. However, ingots having a higher width to thickness ratio exhibit increasing amounts of curl.

Butt curl is a problem primarily because it results in an undesirable amount of end scrap that must be removed from an ingot prior to rolling. Another problem may arise as a result of butt curl, if the rate of curl or inward solidification shrinkage exceeds the casting rate. If the ingot is being cast downwardly at a slow rate, the solidified shell of the ingot may actually be rising upwardly at a faster rate toward the mold in response to the curl. If this upward movement occurs for an extended time period, the hot molten metal in the crater may actually melt through the rising bottom causing a metal breakout. Likewise, if the solidified shell has risen above the mold/metal interface, the shell thickens and shrinks away from the mold leaving a wide gap between the mold and the ingot. Then, as the ingot proceeds downward, the molten metal spills over the solidified edge and rushes outwardly of the mold through the gap between the mold and the ingot. This condition is commonly called a "yo-out". These problems are particularly apparent when casting ingots having high width to thickness ratios. For example, ingots having a width of from approximately 40 to 72 inches (1016 to 1829 mm), and a thickness of from approximately 20 to 26 inches (508 to 660 mm), typically required slow casting speeds during the initial stages of the continuous casting operation.

It has been known that cural can be affected by altering the cooling effect of the direct water. For example, it appears that curl can be reduced by retarding the cooling effect during the first few inches of ingot emergence. One attempt at retarding direct cooling to reduce curl, as disclosed in U.S. Pat. No. 3,441,079, involves pulsing the cooling water from "full on" to "full off" positions for predetermined cycles of time. Such a pulsed water system can require a relatively elaborate pump and valve system to intermittently stop and start the water flow completely and can introduce other complications, especially considering water flow rates sometimes in excess of 300 gallons (1135.5 liters) per minute per mold. If the "full off" time cycle is a pulsed water system is too long, the metal may remelt and perhaps burn through the previously solidified ingot wall.

Butt swell is the term used to describe the undesirable increased thickness of the butt or bottom end of a continuously cast ingot, as illustrative in FIG. 3. Typically ingot molds of rectangular cross section are provided with the longer sidewalls having a pronounced convex curvature. Since solidification shrinkage is greatest near the middle of the longer sidewalls, the convex curvature provided on the ingot sidewalls compensates for such shrinkage. Thus, the convex curvature is practically eliminated after ingot solidification resulting in substantially planar ingot sidewalls on the finally cooled ingot. The exception to the elimination of the convex curvature is at the butt end of the ingot. Since the initial stages of the continuous casting operation employ a relatively slow casting rate, and because the butt end of the ingot lies adjacent a starting block rather than contiguous metal, the initial ingot cooling rate is considerably higher than the cooling rate under stable running conditions. Slow casting rates and rapid solidification at the start of a casting sequence minimize the desirable amount of solidification shrinkage. Therefore, the longer sidewalls retain the bowed configuration provided by the mold until the cooling rate is stabilized, and the casting rate is increased.

Butt swell is a problem because it interferes with normal production handling. Besides causing ingot stacking difficulties, ingots exhibiting butt swell must be subjected to additional conditioning operations prior to rolling. It is common to scalp the entire rolling faces of most ingots. Since scalpers have limited cutting capabilities, it is frequently necessary to remove deformities such as swell before scalping the remainder of the ingot. These additional operations remove excessive metal and require more scalper time, adding to the cost of the ingot.

U.S. Pat. No. 3,933,192 discloses a process for producing continuously cast ingot without butt swell. This disclosed process involves advancing an ingot through a mold having substantially planar sidewalls, then when the casting speed is increased above the low initial speed, the sidewalls of the mold are flexed outwardly. By this process the sidewalls of the butt end of the ingot will conform to the substantially planar sidewalls of the mold, while the sidewalls of the remainder of the ingot, which are cast through a flexed mold, will experience solidification shrinkage and also be generally planar upon final cooling.

Although particularly adapted to vertical casting, the present invention may have utility with regard to horizontal casting. A typical bottleneck in the horizontal direct chill (HDC) continuous casting operation involves running short of available molten metal. When metal runs short, the casting rates may have to be cut back intermittently. During such cutback it is important to retain the same molten crater size and the same head. Since reduced casting rates alone result in increased ingot solidification rates, something must be done with respect to the cooling operation to increase the shrinkage or the ingot will develop a convex shape on the rolling faces. It has been found that uniformly retarding the cooling effect of the direct chill liquid medium in horizontal casting results in maintaining uniformity, with respect to ingot surface contour, during periods of reduced casting rates.

Accordingly, an economical and effective method of uniformly retarding the cooling effect of the liquid medium particularly during continuous casting is desired that will eliminate surface deformities that otherwise occur on the surfaces, particularly the butt end, of a continuously cast ingot.

SUMMARY OF THE INVENTION

This invention may be summarized as providing an improved method of continuously casting metal ingots to minimize surface deformities, particularly those occurring on the butt end thereof. This method comprises the steps of introducing molten metal into an open-ended mold, applying a liquid cooling medium to the mold to effectuate at least partial solidification of the molten metal in the mold and advancing an ingot from the mold, with the ingot having the peripheral portion, at least, solidified while applying liquid cooling medium to the exterior surfaces of the emerging ingot. The improvement of the present method comprises retarding the cooling effect of the liquid cooling medium by mixing a gas with the medium to be applied to the ingot surface prior to such application, whereupon at least the majority of the gas forms a layer of gaseous insulation between the cooling medium and the ingot surface upon application of the medium to the ingot surface.

Among the advantages of the present invention is the provision of a method for minimizing deformities on the butt ends of continuously cast ingot.

It follows that an objective of the present invention is to minimize butt curl and swell on continuously cast ingot.

Another advantage of the present invention is the provision of a significantly economical method of retarding the direct cooling during the critical, initial stages of continuous casting.

A further advantage of this invention is that the same quantity of a coolant is constantly being applied to the surface of an advancing ingot without any interruption of cooling that could result in burn-through of a previously solidified ingot wall.

The method of the present invention also provides for coolant that is uniformly applied about the surfaces of an advancing ingot. Sucn uniformity or even cooling is experienced whether the cooling effect is being retarded or not.

These and other objectives and advantages of this invention will be more fully understood and appreciated with reference to the following detailed description and the drawings appended hereto.

DESCRIPTION OF THE PREFERRED EMBODIMENTS

The term "continuous" as used herein, refers to the progressive and uninterrupted formation of a cast metal ingot in a mold which is open at both ends. The pouring operation may continue indefinitely if the cast ingot is cut into sections of suitable length at a location away from the mold. Alternatively, the pouring operation may be started and stopped in the manufacture of each ingot. The latter process is commonly referred to as semicontinuous casting and is intended to be comprehended by the term "continuous".

Figure 1:
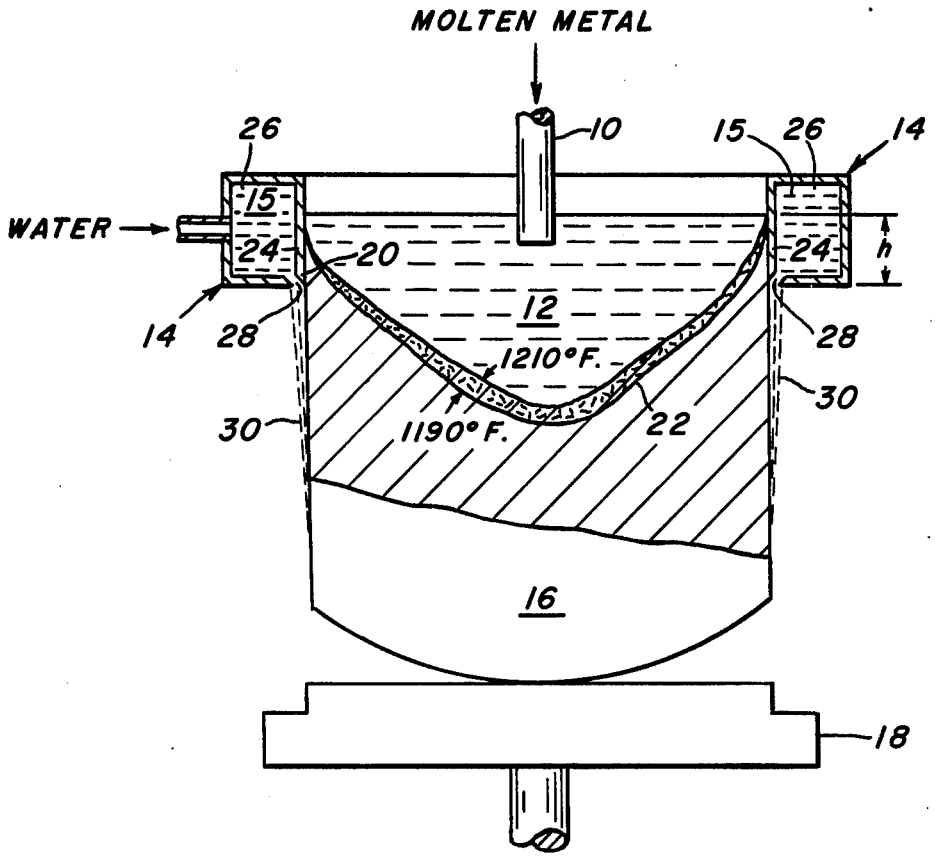
FIG. 1. (PRIOR ART)
FIG. 1 is an elevation view, partially in cross section, illustrating a typical unit used for continuously cast ingots.
Figure 2:
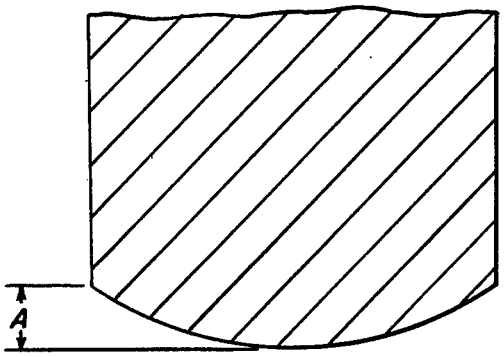
FIG. 2 is an elevation view in cross section of the butt end of a continuously cast rectangular ingot illustrating a deformity herein referred to as butt curl.
Figure 3:
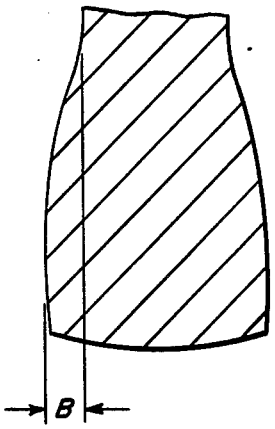
FIG. 3 is an elevation view in cross section at the center of the butt end of a continuously cast rectangular ingot illustrating a deformity herein referred to as butt swell.

Referring particularly to the drawing, FIG. 1 illustrates a typical apparatus used for continuously casting ingots. The apparatus shown in FIG. 1 generally includes a pouring spout 10 for molten metal 12, and a casting mold 14 generally defining the transverse dimensions of the ingot 16 being cast. The apparatus also includes a vertically movable bottom block 18 which closes the lower end of the mold 14 at the beginning of the casting operation and by its descent determines the rate at which the ingot 16 is advanced from the mold 14.

In order to insure that the continuous casting operation is understood, a few definitions should be provided at the outset. Metal "head" is defined as distance the ingot shell travels in the mold 14 before it emerges from the bottom 20 of the mold 14. Head is measured from the meniscus of the molten metal in the mold 14 to the bottom or end 20 of the mold 14. Head is illustrated in FIG. 1 by dimension "h". "Crater" is in the term used to define the molten metal pool which exhibits an inverted, generally wedge-shaped configuration from the meniscus of the molten metal level in the mold 14 to a location some distance from the exit end 20 of the mold 14, which is centrally located in the ingot 16. Although the cross-sectional crater profile is often illustrated as a solid line separating molten metal from solid metal, it will be understood by those skilled in the art that there is a mushy zone 22 where the metal is not fully solid yet not really liquid separating the molten and solid phases. For aluminum ingot, such as Aluminum Association Alloy 3003, the mushy zone exists where the metal exhibits a temperature of from about 1190° F. (643° C.) to about 1210° F. (656° C.), and for Aluminum Association Alloy 3004, the mushy zone exists where the metal temperature ranges from about 1165° F. (629° C.) to about 1210° F. (656° C.).

In the typical continuous casting process, molten metal may be transferred to the casting unit directly from a furnace or from a melting crucible. The molten metal is poured through a pouring spout 10 or the like into a mold 14 having its bottom closed by a bottom block 18. Flow control devices (not shown) may be provided to minimize cascading and turbulent metal flow and to insure even metal distribution.

The mold 14 is externally cooled, usually with a liquid cooling medium such as water. Constructing the mold of a material having high thermal conductivity, such as aluminum or copper, insures that the coolant temperature is transferred as efficiently as possible through the inner mold wall 24 to the metal to effect solidification.

The coolant, typically water, used for direct cooling in the continuous casting unit illustrated in FIG. 1 is provided from the same supply used to cool the mold 14. It should be understood that a more flexible cooling arrangement can be obtained from dual cooling, wherein the water supply to the mold is separate from the water supply to the ingot. In the vertical casting unit illustrated in FIG. 1, water 15 is pumped under pressure into the hollow passageway 26 within the mold at a rate of approximately 200 to 350 gallons (757 to 1325 liters) per minute. As long as the water temperature is less than about 90° F. (32° C.) and greater than about 32° F. (0° C.), cooling efficiency is not significantly affected. The water fills the passageway 26 and is fed through multiple orifices 28 spaced around the mold 14 and extending through the lower inside corner of the mold 14. The orifices 28 are constructed and spaced such that the cooling water fed therethrough is directed against the exterior surfaces of the ingot 16 forming a uniform blanket of water 30 about the emerging portion of the ingot.

At the initiation of a casting sequence, as the molten metal is poured into the closed, water-cooled mold 14, the metal temperature quickly drops to not much above the liquidus. When there has been sufficient peripheral solidification of the ingot 16, the bottom block 18 is lowered. Those skilled in the art recognize that the major cooling effect remains outside the mold by direct cooling. Coolant contact during direct cooling must be proper to insure uniformity. Proper contact requires that the direction, rate and pressure of the coolant be relatively constant. Uneven contact will cause uneven heat flow conditions which may adversely affect ingot quality. Light metals, such as aluminum, magnesium and particularly Aluminum Association Alloys in the 1XXX, 3XXX and 5XXX series, are found particularly adapted to the method of the present invention.

At the beginning of the continuous casting operation, the bottom block 18 is lowered at a slow rate. Starting casting rates of about 1.5 to 2.5 inches (38.1 to 63.5 mm) per minute are common. After an ingot has emerged about two to five inches (50.8 to 127.0 mm) from the mold, the casting rate may be increased. Running casting rates of 2.0 to 6.0 inches (50.8 to 152.4 mm) per minute are typical.

Metal head during continuous casting is usually held as constant as possible. A head of from about 1.25 to 1.75 inches (31.75 to 44.45 mm) is considered a low head, while a head of from about 2.5 to 3.5 inches (63.5 to 88.7 mm) is considered a normal head. A variable head, which starts normal and after start-up is run low, may be preferred for certain ingots having high width to thickness ratios because of their difficulty in starting. From an economical and increased production rate viewpoint, it is more efficient to start and run with a low head.

Figure 4:
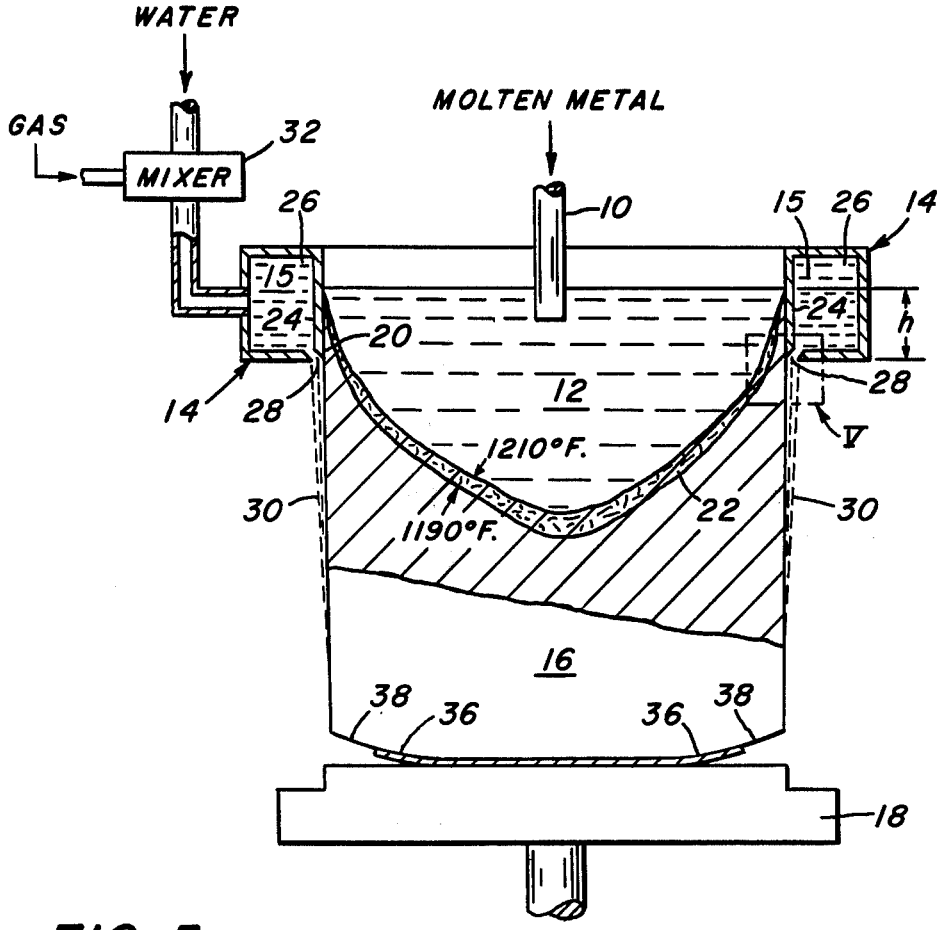
FIG. 4 is an elevation view, partially in cross section, illustrating a unit used for continuously casting ingots in accordance with the present invention.

FIG. 4 illustrates the improvement of the present invention. As shown in FIG. 4, a soluble gas is mixed and dissolved into the coolant under pressure prior to the feeding of the coolant to the mold 14 and to the exterior surfaces of the ingot 16.

The gases comprehended by the present invention include any that are soluble in the cooling medium. When water is used as the coolant, the gases comprehended include carbon dioxide, air, nitrogen and furnace gas. Besides being water soluble, such gases must come out of solution when pressure drops. It should also be noted that a temperature rise in the cooling water may have an effect on the release of the gas from solution. A preferred gas of the present invention is carbon dioxide because of its availability, relatively low cost and its high solubility in water, a process referred to as carbonation, at a low pressure of about one to four atmospheres. Other gases which may be employed include, but are not limited to, air, nitrogen and certain waste gases.

Carbonation is measured in terms of volumes. At atmospheric pressure and at a temperature of 60° F. (16° C.), a given volume of water will absorb an equal volume of carbon dioxide and is said to contain one volume of carbonation. Solubility of carbon dioxide in water is directly proportional to pressure but decreases with increasing temperature.

By the process of the present invention, gas is dissolved into the ingot cooling water under pressure of above five psig or higher. The dissolving may readily take place in an absorption or mixing device 32, such as a pump or a static mixer. The gas is dissolved into the ingot cooling water prior to the feeding of the water onto the exterior ingot surfaces. In a single supply water system, as illustrated in FIG. 4, it is practical to dissolve the gas in the water, before the water is fed to the mold. Preferably at least 50% of the gas used with the coolant is dissolved with the coolant.

Figure 5:
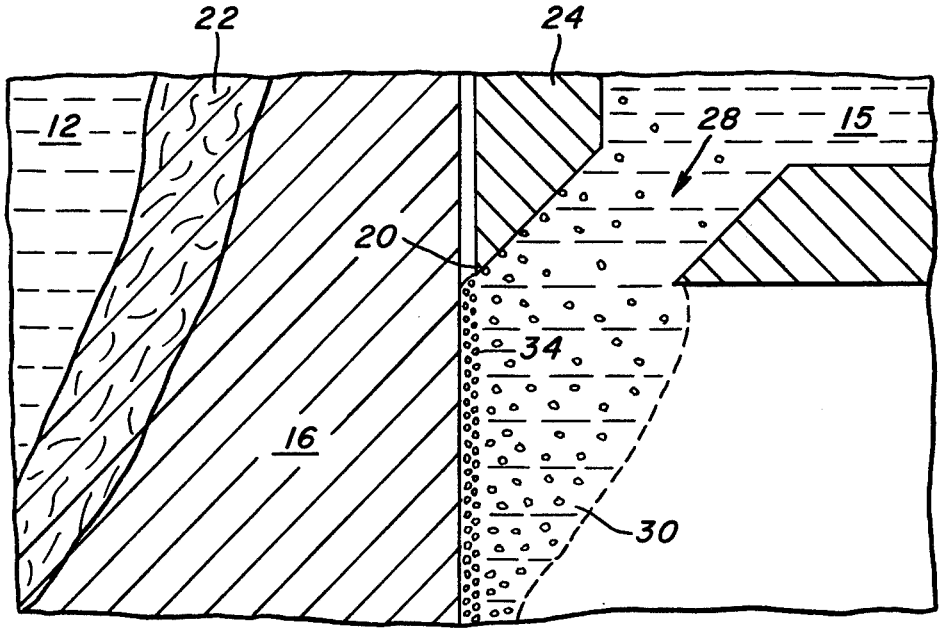
FIG. 5 is an enlarged cross-sectional view of a portion of the unit illustrated in FIG. 4.

As mentioned above, the dissolved gas comes out of solution when pressure drops. As illustrated in FIG. 5, which is an enlarged view of Section V of FIG. 4, a portion of the released gas adheres to the exterior surface of the emerging ingot 16 forming a uniform, yet effective, insulation layer 34 which acts to retard the heat extraction otherwise effectuated by the cooling medium. It has been found that the use of sufficient dissolved carbon dioxide in cooling water to provide a continuous gaseous blanket on the ingot surface results in the formation of an insulation layer which can reduce the normal heat transfer rate by a ratio of approximately ten to one. Therefore, practicing the method of the present invention during the initial stages of the vertical continuous casting operation results in a reduction of ingot butt curl and, to some extent, butt swell.

To achieve significant reductions in ingot butt swell, an insulation pad 36, typically a ceramic fiber blanket or the like, may be utilized as a cover over, preferably, at least 50% to 60% of the bottom face 38 of the ingot to minimize heat loss through the bottom block 18. It will be understood that such insulation pad 36 would not remain in contact with the bottom face 38 of the ingot and could not function adequately if butt curl were too excessive; therefore, the use of dissolved gases to reduce butt curl complements the use of an insulation pad 36 to reduce butt swell.

It will be understood by those skilled in the art that the insulation layer 34 shown in the enlarged cross-sectional view of FIG. 5 is constantly renewing. The volume of water being fed onto the ingot surfaces is too great to expect the insulation layer to be unaffected by flow rate. Therefore, it is expected that the insulation layer of gas 34 is constantly being eroded, yet substantially simultaneously is being replaced by the released gas contained in the incoming water. The gas particles tend to follow the path of least resistance, and, therefore, a larger portion of the gas particles are automatically washed out of the system. However, gas particles tend to adhere to a surface; therefore, there is always a uniform layer 34 of gas particles on the ingot surface as long as the gas is being dissolved in the coolant.

Minimizing ingot butt deformities requires retarding the cooling effect of the direct chill coolant during the initial stages of the continuous casting operation. This can be accomplished, for example, by dissolving from 10 to 30 SCFM (0.0046 to 0.0142 cubic meters per second) of carbon dioxide into the cooling water. Usually, after the first two to four inches (50.8 to 101.6 mm) of an ingot have emerged from the mold, the insulating layer of gas 34 is no longer required. To remove the insulating layer 34, all that is required is to shut off the gas flow. Preferably such shut-off is gradual so as to progressively increase the rate of heat extraction provided by the coolant, and thereby eliminate extreme imbalance of the overall cooling process. A typical gas flow rate of 22 SCFM (0.0104 cubic meters per second) of carbon dioxide in about 250 gallons (946 liters) per minute of water is preferably reduced to a near zero gas feed rate over a period of about two minutes. Thus, after less than about twelve inches (254.0 mm) of ingot emergence, which constitutes the initial stage of casting, substantially no gas is being dissolved into the coolant.

The flow of the liquid coolant in terms of pressure, direction and rate is not changed throughout the casting operation. The cooling water, whether containing dissolved gas or not, is uniformly applied to the exterior surfaces of the ingot without distorting the configuration of the water blanket 30 about the ingot 16. Such uniformity is not only economical but also promotes even thermal solidification patterns and thus enhances ingot quality.

The present invention is illustrated in the following examples:

EXAMPLE 1

An ingot was cast in a vertically disposed rectangular water cooled aluminum mold having a width of 59 inches (1498.6 mm) and a thickness of 20 inches (508.0 mm). Water having a temperature of about 45°-50° F. (7° to 10° C.) was applied to the mold and the descending ingot at a rate of about 250 gallons (946 liters) per minute throughout the casting operation. Aluminum Association Alloy 3003 was employed in this example. The molten metal was supplied to the mold at a temperature of about 1300° F. (704° C.) A low head of about 1.5 inches (38.1 mm) was maintained during casting. The starting casting rate was about two inches (50.8 mm) per minute or, for an ingot of this size, about 16,000 pounds (7258 kg) per hour. Carbon dioxide was dissolved in the cooling water at 22 SCFM (0.0104 cubic meters per second), and after the ingot had emerged about three and one-half inches (88.7 mm) from the mold or after about two minutes, the carbon dioxide feed was reduced progressively for another two minutes. Thus, after the ingot had emerged a total of about seven and one-half inches (190.5 mm) from the mold, substantially no carbon dioxide was in the cooling water. Running casting speed was increased progressively to about five inches (127.0 mm) per minute or about 32,000 pounds (14,515 kg) per hour. Where there has been no retardation of direct chill water cooling, butt curl on such an ingot has been measured as high as four and one-half inches (114.3 mm). In this example, however, butt curl was merely 0.75 inch (19.05 mm).

EXAMPLE 2

The same procedure as set forth in Example 1 was followed except that the mold had a width of 66 inches (1676.4 mm) and a thickness of 20 inches (508.0 mm). Butt curl on such ingots having a high width to thickness ratio has been so excessive that the ingots could not be cast without retarding the direct cooling. In this example, retarding the cooling in accordance with the present invention minimized butt curl to less than two inches (50.8 mm).

EXAMPLE 3

The same procedure as set forth in Example 2 was followed. Additionally, a ceramic fiber insulation pad was employed on the ingot contacting surface of the bottom block to minimize heat loss through the bottom block. The insulation pad covered about 60% of the bottom surface of the cast ingot. Butt swell on the ingot was reduced to 0.25 to 0.50 inch (6.35 to 12.7 mm). Without such insulation pad, butt swell on a 20 by 66 inch (508.0 by 1676.4 mm) ingot of 3003 alloy has been measured as high as 1.5 inches (38.1 mm).

Whereas the preferred embodiments of the present invention have been described above for purposes of illustration, it will be apparent to those skilled in the art that numerous variations of the details may be made without departing from the invention. For example, casting in the horizontal direction in accordance with the method of the present invention will also provide a gaseous layer of insulation between the liquid cooling medium and the exterior surface of the ingot, such as that illustrated for a vertically cast ingot, as shown in FIG. 5.

I claim:

1. In a method for continuously casting light metal ingots wherein molten metal is continuously supplied to an open-ended mold, wherefrom an ingot is continuously withdrawn, wherein liquid coolant is directed to the surface of the ingot emerging from the mold to extract heat therefrom, and wherein casting is initiated by withdrawing from the mold a starting block initially closing the mold, wherein the improvement comprises:

at the initial stage of casting, mixing a gas with the liquid coolant before direction of the liquid coolant to the ingot and directing said liquid coolant carrying said gas in a substantially continuous liquid phase to an initial portion of ingot length as it emerges from said mold thereby to extract heat at a retarded rate from said initial portion of ingot length, and, thereafter, reducing the amount of gas mixed with said liquid coolant directed to said ingot emerging from said mold to provide for an increased rate of heat extraction by said liquid coolant for subsequent portions of emerging ingot length.

2. The method as set forth in claim 1 wherein the liquid coolant is water.

3. The method as set forth in claim 1 wherein the light metal is selected from the group consisting of aluminum, magnesium and their alloys.

4. The method as set forth in claim 1 wherein the gas comprises at least one gas selected from the group consisting of carbon dioxide, air and nitrogen.

5. The method as set forth in claim 1 wherein at least 50% of the gas mixed with the coolant is dissolved into the coolant.

6. The method as set forth in claim 5 wherein gas is dissolved under pressure in said liquid coolant prior to its application to the ingot and whereupon dissolved gas comes out of solution in response to a decrease in pressure as the liquid coolant is directed to the ingot.

7. In a method for continuously casting ingots of aluminum, magnesium or their alloys comprising the steps of substantially continuously introducing molten metal to an open-ended mold;

continuously applying liquid cooling medium to the mold to effectuate at least partial solidification of the molten metal therein; and continuously withdrawing an ingot from the mold, said ingot having its periphery, at least, solidified, while simultaneously directing liquid cooling medium comprising water to the exterior surfaces of the ingot emerging from the mold to extract heat therefrom; the improvement comprising:

dissolving a soluble gas into said liquid cooling medium comprising water prior to its direction to the emerging ingot surface and directing said liquid cooling medium as a substantially continuous liquid phase containing said dissolved gas to a portion of ingot length emerging from the mold, whereupon dissolved gas comes out of solution to retard the rate of heat extraction from said ingot length portion by said liquid cooling medium, and subsequently reducing said dissolving of said gas to increase the cooling effect of said liquid cooling medium and directing said cooling medium to different portions of ingot length emerging from said mold to increase the rate of heat extraction from said different portions of ingot length.

8. The method as set forth in claim 7 wherein the gas comprises carbon dioxide.

9. The method as set forth in claim 7 wherein the soluble gas comprises any gas able to be dissolved into the liquid cooling medium under pressure and which gas comes out of solution in response to a decrease in pressure.

10. The method as set forth in claim 7 wherein the soluble gas comprises at least one gas selected from the group consisting of carbon dioxide, air, and nitrogen.

11. The method as set forth in claim 7 wherein said ingot portion which is cooled at said retarded rate of heat extraction is withdrawn from said mold at a slower rate than said different portions cooled at said increased rate of heat extraction.

12. In a method for continuously casting a substantially rectangular cross-sectional aluminum alloy ingot having a width to thickness ratio greater than one comprising the steps of substantially continuously introducing molten aluminum to an open-ended mold having an inlet end, a generally rectangular passageway therethrough and an outlet end, the outlet end being initially closed by a movable starting block;

continuously directing water to the mold to effect at least partial solidification of the molten aluminum therein to provide a peripherally solidified ingot;

continuously advancing the peripherally solidified ingot by withdrawing the starting block and ingot connected thereto from the outlet end of the mold at a starting casting rate of approximately two inches per minute while simultaneously directing cooling water to the exterior surfaces of the ingot emerging from the mold to extract heat therefrom;

the improvement comprising:

dissolving at atmospheric pressure or higher a gas comprising carbon dioxide into, at least, the cooling water which is directed to the ingot surface, thereby to carbonate said water prior to its direction to the ingot surface, directing said carbonated water as a substantially continuous liquid phase containing said gas to the ingot emerging from the mold, whereupon dissolved carbon dioxide comes out of solution, thereby to retard the rate of heat extraction from the ingot, said retarded rate of heat extraction being maintained for a period of, at least, from when the ingot withdrawal from the mold begins until the ingot has emerged about two to four inches from the mold, and thereafter progressively reducing the amount of carbon dioxide dissolved into the cooling water thereby to increase the heat extraction rate from subsequent portions of the ingot while simultaneously increasing the casting rate.

13. The method as set forth in claim 12 wherein substantially no carbon dioxide is being dissolved into the cooling water after the ingot has emerged about eight to ten inches from the mold.

14. The method as set forth in claim 13 wherein a casting rate of at least four inches per minute is attained when substantially no carbon dioxide is being dissolved into the cooling water.

15. The method as set forth in claim 12 wherein the improvement further comprises reducing heat loss through the bottom surface of the emerging ingot by positioning an insulation pad between the starting block and the ingot, said pad covering at least 50% of said bottom surface.

16. The method as set forth in claim 15 wherein the insulation pad is ceramic fiber.

17. In a method for continuously casting aluminum alloy ingot having a width of 40 to 72 inches and a thickness of 20 to 26 inches comprising the steps of substantially continuously introducing molten aluminum to an open-ended mold having an inlet end, and an outlet end, the outlet end being intially closed by a movable starting block;

continuously directing from 200 to 350 gallons per minute of cooling water at a temperature of from about 32° to 90° F. to the mold to effect at least partial solidification of the molten aluminum therein to provide a peripherally solidified ingot;

continuously advancing the peripherally solidified ingot by withdrawing the starting block and the ingot connected thereto from the outlet end of the mold at a starting casting rate of approximately two inches per minute while simultaneously directing from 200 to 350 gallons per minute of cooling water at a temperature of from about 32° to 90° F. to substantially the entire periphery of the ingot emerging from the mold to extract heat therefrom; and maintaining a relatively constant head of from 1.25 to 3.50 inches of molten aluminum in the mold throughout the casting operation;

the improvement comprising:

dissolving at a pressure of about five psig or higher about 10 to 30 SCFM of a gas comprising carbon dioxide into, at least, the cooling water which is directed to the ingot periphery thereby to carbonate said water prior to its direction to the ingot periphery emerging from the mold;

directing said carbonated water as a substantially continuous liquid phase containing said gas to the ingot periphery emerging from the mold, whereupon dissolved gas comes out of solution in response to a pressure decrease thereby to retard the rate of heat extraction from said emerging ingot by said cooling water for a period, at least, from the time when the ingot begins its emergence from the mold until the time when the ingot has emerged about two to four inches from the mold;

for the next four to eight inches of ingot emergence, progressively reducing the amount of gas comprising carbon dioxide dissolved into the cooling water directed to the ingot periphery emerging from the mold, thereby to increase the rate of heat extraction from the ingot emerging from the mold while simultaneously increasing the casting rate, such that substantially no carbon dioxide is being dissolved into the cooling water, and a casting rate of from four to six inches per minute is attained when the ingot has emerged a total of from six to twelve inches from the mold; and reducing heat loss through the bottom surface of the emerging ingot by positioning an insulation pad between the starting block and the bottom surface of the ingot, said pad covering at least 50% of said bottom surface.

18. A method for retarding the cooling effect of a liquid cooling medium used to cool the exterior surfaces of a metal ingot as said ingot is being continuously cast from a mold comprising:

dissolving soluble gas into the liquid cooling medium prior to directing the medium to the exterior surfaces of the continuously cast ingot, during a reduction in the casting rate; and directing the liquid cooling medium as a substantially continuous liquid phase containing said gas to the exterior surfaces of the ingot emerging from the mold, whereupon dissolved gas comes out of solution thereby to retard the rate of heat extraction from said ingot emerging from said mold during said reduced casting rate;

thereafter reducing the amount of gas being dissolved into the liquid cooling medium and increasing the casting rate;

directing said liquid coolant with said reduced gas content substantially as a continuous liquid phase containing said gas to the ingot emerging from the mold thereby to increase the rate of heat extraction from said ingot emerging from said mold during said increased casting rate.

19. The method as set forth in claim 18 wherein the liquid cooling medium is water.

20. The method as set forth in claim 18 wherein the soluble gas comprises at least one gas selected from the group consisting of carbon dioxide, air and nitrogen.

21. The method as set forth in claim 18 wherein the ingot is a light metal selected from the group consisting of aluminum, magnesium and their alloys.

22. In a method for continuous casting of metal ingots wherein a mold is continuously supplied at its entrance end with molten metal and wherein a solidified or partially solidified ingot is continuously withdrawn from its exit end and wherein heat is extracted from the ingot emerging from the exit end of the mold by directing a liquid cooling medium to the ingot surface, the improvement comprising:

(a) retarding the rate of heat extraction from the ingot by said liquid cooling medium for a portion of ingot length by mixing a gas into the liquid cooling medium and applying said liquid cooling medium carrying said gas in a substantially continuous liquid phase to said portion of ingot length as it emerges from said mold;

(b) thereafter increasing the rate of heat extraction for a subsequent portion of ingot length as it emerges from the mold by reducing the amount of gas mixed with the liquid cooling medium directed to said subsequent ingot length portion.

23. In the method according to claim 41 wherein the liquid cooling media is water.

24. In the method according to claim 22 wherein the gas comprises one or more gases selected from the group consisting of carbon dioxide, air and nitrogen.

25. In the method according to claim 22 wherein the gas comprises carbon dioxide.

26. In the method according to claim 22 wherein the metal is selected from the group consisting of aluminum, magnesium, or alloys thereof.

27. In the method according to claim 22 wherein said retarding of said heat extraction rate is performed in association with the commencement of casting and ingot withdrawal from said mold.

28. In the method according to claim 22 wherein the ingot is withdrawn at a slower rate during the period of said retarded rate of heat extraction and at a higher rate during the period of said increased rate of heat extraction.

29. In the method according to claim 22 wherein gas is dissolved in said liquid cooling medium prior to its direction to the ingot and whereupon dissolved gas comes out of solution as said liquid cooling medium is directed to said ingot to retard the heat extraction by said cooling medium.

30. In the method according to claim 22 wherein gas is dissolved under pressure in said liquid cooling medium prior to its direction to the ingot and whereupon dissolved gas comes out of solution as the cooling medium is directed to said ingot and said pressure is reduced.

31. In the method according to claim 30 wherein said gas comprises carbon dioxide.

32. In the method according to claim 29 wherein said gas comprises carbon dioxide.

33. In the method according to claim 30 wherein said liquid containing said gas dissolved under pressure is used to cool the mold prior to being directed to said ingot.

34. In the method according to claim 30 wherein said liquid containing said gas dissolved under pressure is used to cool the mold prior to being directed to said ingot and said gas is substantially retained in solution while cooling said mold.

35. In the method according to claim 22 wherein said gas forms a gaseous layer of insulation between the liquid cooling medium and said ingot during said retarded heat extraction.

36. In the method according to claim 22 wherein said retarding of said heat extraction rate is performed at the commencement of casting and wherein the withdrawal of the ingot is initiated by withdrawing from the mold a temporary closure attached to the emerging ingot, the improvement further comprising reducing heat extraction through the ingot front surface by providing an insulation pad between said temporary closure and said ingot front surface.

37. In the method according to claim 22 wherein said ingot has a width to thickness ratio of more than one.

38. In the method according to claim 22 wherein a relatively constant and relatively low molten metal head of about 1.25 to 1.75 inches is maintained in the mold substantially throughout the casting operation.

39. In the method according to claim 22 wherein relatively constant molten metal head within 1.25 to 3.5 inches is maintained substantially throughout casting.

40. In the method according to claim 22 wherein the molten metal head is changed during casting.

41. In the method according to claim 22 wherein the rate of liquid cooling media is substantially the same during both retarded and increased heat extraction periods.

42. In the method according to claim 12 wherein a relatively low head of about 1.25 to 1.75 inches of molten aluminum is maintained substantially thoughout the casting operation.

43. In the method according to claim 12 wherein a head of 2.5 to 3.5 inches of molten aluminum is maintained thoughout the casting operation.

44. In the method according to claim 5 wherein the gas comprises carbon dioxide.

45. In the method according to claim 6 wherein the gas comprises carbon dioxide.

46. In the method according to claim 12 wherein a gas comprising carbon dioxide is dissolved under positive pressure and carbon dioxide comes out of solution as the cooling water is directed to the ingot emerging from the mold.

47. In the method according to claim 15 wherein 10 to 30 SCFM of said gas comprising carbon dioxide is continuously dissolved into said water coolant before its direction to the ingot emerging from the mold and said water coolant is directed to said ingot at a rate of more than 200 gallons per minute.

48. In the method according to claim 12 wherein said aluminum alloy is alloy 3003 or alloy 3004.

49. In the method according to claim 22 wherein gas is dissolved in said liquid cooling medium prior to its direction to the ingot and whereupon dissolved gas comes out of solution as said liquid cooling medium is directed to said ingot to retard the heat extraction by said cooling medium and wherein the ingot is withdrawn at a slower rate during the period of said retarded rate of heat extraction and at a higher rate during the period of said increased rate of heat extraction.

* * * * *

UNITED STATES PATENT AND TRADEMARK OFFICE

CERTIFICATE OF CORRECTION

PATENT NO. : 4,166,495

DATED : September 4, 1979

INVENTOR(S) : Ho Yu

It is certified that error appears in the above-identified patent and that said Letters Patent are hereby corrected as shown below:

| | |
|---|---|
| Abstract, line 7 | Change "solidifed" to --solidified--. |
| Col. 2, line 9 | Change "buttom" to --bottom--. |
| Col. 2, line 45 | Change "required" to --require--. |
| Col. 2, line 48 | Change "cural" to --curl--. |
| Col. 2, line 61 | Change "is" to --in--. |
| Col. 2, line 67 | Change "illustrative" to --illustrated--. |
| Col. 4, line 38 | Change "Sucn" to --Such--. |
| Col. 5, line 24 | After "is", delete "in". |
| Col. 7, line 13 | After "gas" change "used" to --mixed--. |

UNITED STATES PATENT AND TRADEMARK OFFICE

CERTIFICATE OF CORRECTION

PATENT NO. : 4,166,495

DATED : September 4, 1979

INVENTOR(S) : Ho Yu

It is certified that error appears in the above-identified patent and that said Letters Patent are hereby corrected as shown below:

| | |
|---|---|
| Claim 23, line 1 | Change "41" to --22--. |
| Claim 24, line 2 | Delete "one or more gases" and insert --at least one gas--. |

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*